US006300969B1

(12) United States Patent
Tanioka

(10) Patent No.: US 6,300,969 B1
(45) **Date of Patent: *Oct. 9, 2001**

(54) RECORDING HEAD AND IMAGE RECORDING APPARATUS USING THE SAME

(75) Inventor: Hiroshi Tanioka, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/902,834

(22) Filed: Jul. 30, 1997

(30) Foreign Application Priority Data

Jul. 31, 1996 (JP) ..... 8-201856

(51) Int. Cl.[7] ..... B41J 2/45
(52) U.S. Cl. ..... 347/238; 347/237; 347/247
(58) Field of Search ..... 347/237, 238, 347/241, 244, 254, 130, 145

(56) References Cited

U.S. PATENT DOCUMENTS

| | | | | |
|---|---|---|---|---|
| 4,684,998 | | 8/1987 | Tanioka et al. | 358/293 |
| 4,706,128 | | 11/1987 | Tanioka et al. | 358/286 |
| 4,835,549 | * | 5/1989 | Samejima et al. | 347/237 |
| 4,899,174 | * | 2/1990 | Newman et al. | 347/245 |
| 4,907,034 | * | 3/1990 | Doi et al. | 355/400 |
| 5,307,089 | * | 4/1994 | Takasu | 347/237 |
| 5,828,400 | * | 10/1998 | Fleming | 347/238 |

FOREIGN PATENT DOCUMENTS

| | | |
|---|---|---|
| 4348962 | 12/1992 | (JP) . |
| 8156325 | 6/1996 | (JP) . |
| 8187889 | 7/1996 | (JP) . |

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

A recording head includes a recording element array including a plurality of linearly arranged recording elements, and a flexible wiring substrate for inputting a recording signal into the recording element array. A matrix-wiring for matrix-driving the plurality of recording elements is formed in the flexible wiring substrate.

5 Claims, 8 Drawing Sheets

RECORDING HEAD AND IMAGE RECORDING APPARATUS USING THE SAME

BACKGROUND OF THE INVENTION

1. Field of the Invention

The present invention relates to a recording head of an image recording apparatus, and in particular, to a recording head in which a large number of recording elements, such as LEDs, for generating recording energy are linearly arranged. The recording head of the present invention is preferably used as a recording head in an image recording apparatus, such as a copying machine of an electrophotographic recording system, a facsimile machine and a printer.

2. Related Background Art

Conventionally, in an image recording apparatus for performing image recording by using the electrophotographic recording system, an LED recording head is used. In the LED recording head, a large number of LED light-emitting recording elements, which are respectively radiated in accordance with recording information, are linearly arranged. As a driving system for driving the LED recording head, a matrix driving system is utilized since this driving system can use an inexpensive driving IC.

Such a recording head of a matrix-driving system is disclosed in Japanese Patent Laid-Open Application Nos. 4-348962, 8-156325 and 8-187889, for example.

In a conventional LED recording head of a matrixdriving system, an LED chip including a plurality of LED devices is die-bonded on a glass epoxy substrate, a matrix-wiring pattern is formed on the substrate and the wiring pattern is wire-bonded to an electrode pad of each LED device.

FIG. 1 illustrates an equivalent circuit of the LED recording head of a matrix-driving system. The recording head includes fifty-six (56) LED chips 2-1 to 2-56 which are linealy arranged. Each of the LED chips 2-1 to 2-56 respectively includes sixty-four (64) LED elements 2-1-1 to 2-1-64 or the like. In each LED chip, LED devices are linearly arranged, and the arrangement direction of those LED devices is coincident with the arrangement direction of the LED chips. The arrangement pitch of the LED devices is approximately 12 pieces/mm, and the recording head is capable of performing recording of an A3 size with a density of 300 DPI (dots per inch).

Anodes of N-th (N=1 to 64) LED devices in the respective LED chips are connected to a common wire and are driven with a constant current by anode drivers 1-1 and 1-2. On the other hand, cathodes of sixty-four (64) LED devices in each LED chip are connected in the chip and are succesively driven in a time-sharing manner by cathode drivers 3-1 to 3-6. The cathode driver is constructed by six (6) chips each sharing ten (10) channels. Therefore, the matrix-driving of 64×56 can be performed.

FIG. 2 illustrates a plan view of the LED chip 2-1. In the LED devices 2-1-1 to 2-1-64, anode terminals of odd-numbered devices extend to an opposite side to those of even-numbered devices (i.e, the lower and upper sides in FIG. 2 respectively), and wire bonding pads (WBPs) 4-1-1 to 4-1-64 are connected to end portions of the respective anode terminals. Therefore, the arrangement pitch of the WBPs is approximately 6 pieces/mm, and a direct wire-bonding between the WBPs and the wiring pattern formed on an ordinary glass epoxy substrate can be executed.

FIG. 3 illustrates a schematic plan view of the above-discussed LED recording head. Fifty-six (56) LED chips 2-1 to 2-56 are die-bonded to a central portion of a glass epoxy substrate 5 with respect to a lateral direction and are arranged along a longitudinal direction of the substrate 5. In regions 15 on both sides of those LED chips, matrix-wiring patterns are formed. The matrix-wiring patterns are is connected to the WBPs of anode terminals of the LED devices in each LED chip by bonding wires (see FIG. 1). At opposite end portions of the substrate 5 with respect to the longitudinal direction, the above-discussed anode drivers 1-1 and 1-2 are respectively mounted. One anode driver 1-1 is connected so as to drive the above-discussed odd-numbered LED devices, and the other anode driver 1-2 is connected so as to drive the above-discussed even-numbered LED devices. That is, though the anode drivers 1-1 and 1-2 are represented as a unit for sixty-four (64) channels in FIG. 1, as a matter of fact those anode drivers 1-1 and 1-2 are respectively located at different positions with each sharing thirty-two (32) channels. Further, cathode terminals of each LED chip extend to a side of the bottom surface of this LED chip (i.e, the surface of the LED chip which is connected to the glass epoxy substrate 5), and those cathode terminals are connected to cathode drivers 3-1 to 3-6 each sharing ten (10) channels.

In such a conventional LED recording head as illustrated in FIG. 3, the width of the glass epoxy substrate 5 is approximately 20 mm, and this value is disadvantageous to a recording apparatus which is intended to be made compact by using a small photosensitive drum.

It is possible to obtain a smaller recording apparatus by forming the matrix-wiring as a multi-layer structure, but such a structure is complicated, hence the number of manufacturing steps and cost are increased. Those facts are disadvantageous to the recording apparatus.

SUMMARY OF THE INVENTION

It is accordingly an object of the present invention to provide a recording head having lower cost and smaller size to solve the above-discussed disadvantages of the prior art technique.

According to one aspect of the present invention, there is provided a recording head in which a recording element array including a plurality of linearly arranged recording elements is arranged, an input of a recording signal into the recording elements is performed through a flexible wiring substrate, and a matrix-wiring for matrix-driving the plurality of recording elements is formed in the flexible wiring substrate.

The following specific configurations can be adopted in the present invention.

The plurality of recording elements are formed into a chip, the chip is mounted onto a first substrate, one end portion of the flexible wiring substrate is bonded to the first substrate and matrixwiring terminals at the one end portion of the flexible wiring substrate are connected to input terminals of the plurality of recording elements formed in the chip by wire bondings.

There are further arranged a support member, a second substrate and a driving element for matrix-driving the plurality of recording elements, the first substrate is mounted onto the support member, the second substrate is mounted onto a side surface of the support member which is approximately perpendicular to a surface of the support member on which the first substrate is mounted, the driving element is mounted onto the second substrate, the other end portion of the flexible wiring substrate is bonded to the second substrate and the other end portion of the flexible wiring substrate is connected to the driving element by a wiring pattern formed on the second substrate.

The flexible wiring substrate is mounted with being bent in an approximately perpendicular form or in an approximately L-shaped form along the support member.

One end portion of the flexible wiring substrate is bonded to the first substrate with thermo-setting adhesive.

The chip is mounted onto the first substrate by using die-bonding.

One part of input terminals of the plurality of recording elements in the chip are arranged on one side with respect to the arrangement of the plurality of recording elements, the other part of input terminals of the plurality of recording elements in the chip are arranged on the other side with respect to the arrangement of the plurality of recording elements, and there are arranged two flexible wiring substrates; one for being connected to the input terminals of the recording elements arranged on the one side and the other for being connected to the input terminals of the recording elements arranged on the other side.

There is formed an additional matrix-wiring in the chip, terminals of the additional matrix-wiring are arranged on one side with respect to the arrangement of the plurality of recording elements and the terminals of the matrix-wiring are connected to terminals of the matrix-wiring formed on one end portion of the flexible wiring substrate.

The recording element comprises an LED device.

The above and other objects and features of the present invention will become apparent from the following description.

DETAILED DESCRIPTION OF THE PREFERRED EMBODIMENTS

Preferred embodiments of the present invention will be described in detail below with reference to the accompanying drawings.

Figure 4:
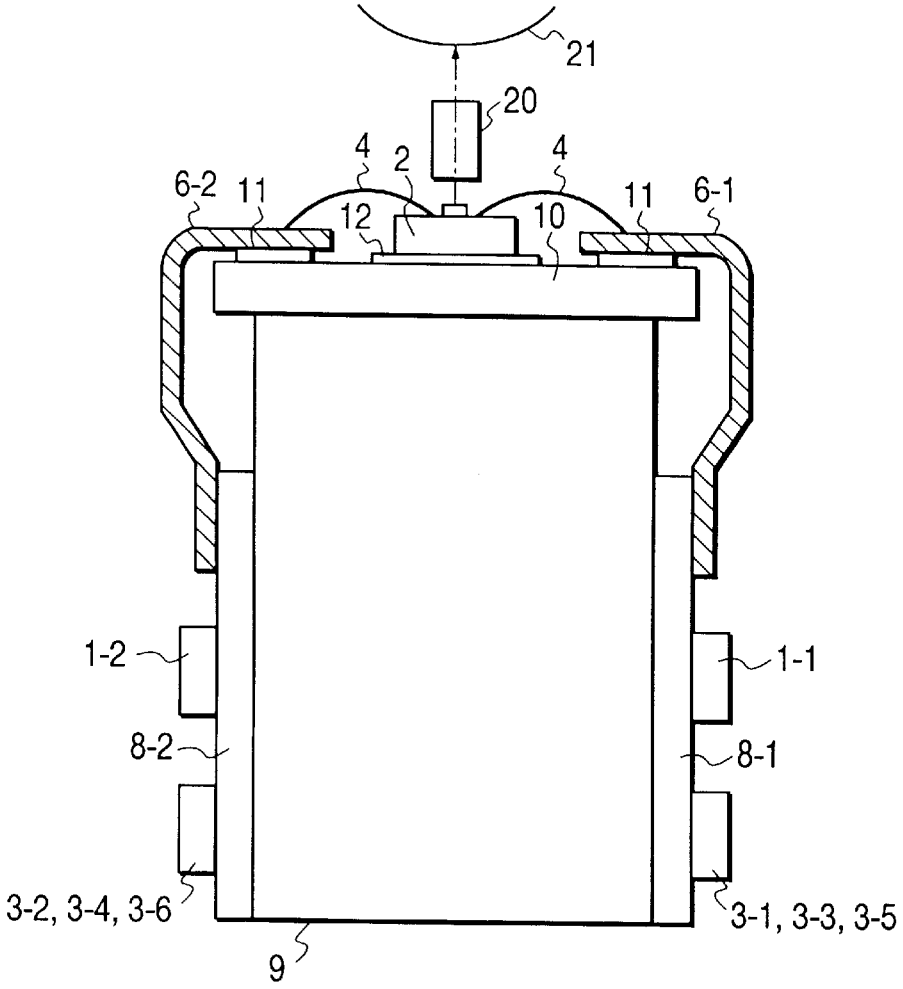
FIG. 4 is a schematic cross-sectional view showing a first embodiment of a recording head according to the present invention.
Figure 5:
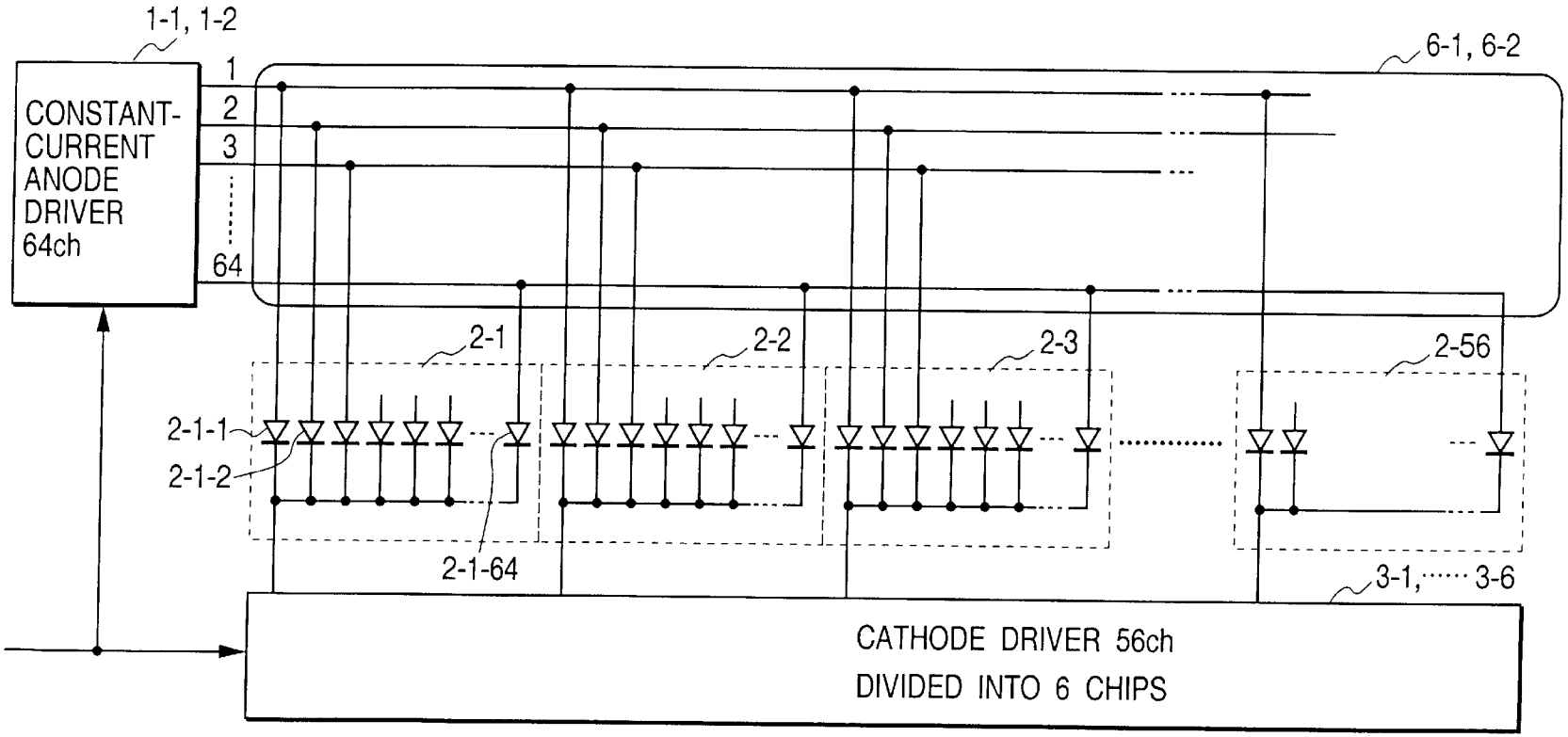
FIG. 5 is a view showing an equivalent circuit of the first embodiment of a recording head according to the present invention.
Figure 6:
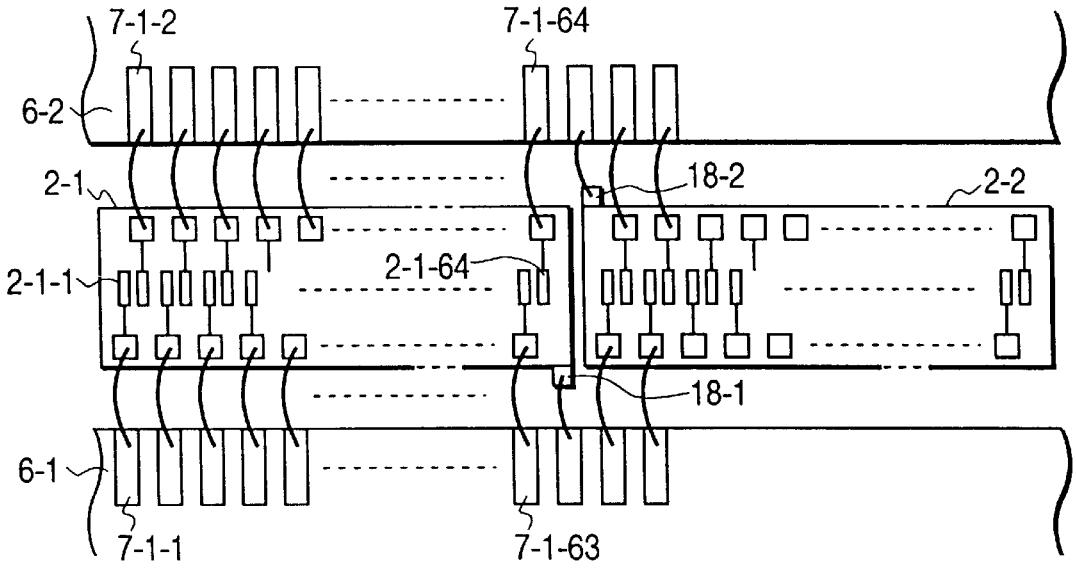
FIG. 6 is a partial plan view showing the first embodiment of a recording head according to the present invention.

FIG. 4 is a schematic cross-sectional view showing a first embodiment of a recording head according to the present invention, which is to be used in an image recording apparatus. FIGS. 5 and 6 are respectively a view showing an equivalent circuit of the first embodiment and a partial plan view showing the first embodiment.

As illustrated in FIG. 4, a glass epoxy substrate (a first substrate) 10 is mounted on an upper surface of a support member 9, and an LED chip 2 is die-bonded with a silver paste 12 to a central portion of the substrate 10 with respect to its widthwise direction. On both opposite sides of the LED chip 2, one ends of flexible wiring substrates 6-1 and 6-2 are connected to the substrate 10 with thermo-setting adhesive 11. Reference numeral 4 designates a bonding wire for connecting a WBP, which is an input terminal of the LED chip 2, and a matrix-wiring terminal at the above-mentioned one end of each flexible wiring substrate 6-1, 6-2.

On both side surfaces of the support member 9, glass epoxy substrates (second substrates) 8-1 and 8-2 are mounted. On the substrates 8-1 and 8-2, there are arranged anode drivers 1-1 and 1-2 and cathode drivers 3-1 to 3-6 which are driving elements for matrix-driving the LED chip 2. Matrix-wiring terminals of the other ends of the flexible wiring substrates 6-1 and 6-2 are connected to wiring patterns formed on the substrates 8-1 and 8-2. As a result, an input of a recording signal into the LED chip 2 is performed through each flexible wiring substrate 6-1, 6-2.

Further, there is arranged a converging optical fiber array 20 opposite -to the LED chip 2 mounted on the substrate 10. Light beams from respective recording elements in the LED chip 2 are condensed by the converging optical fiber array 20 and projected onto a photosensitive medium (a photosensitive drum) 21 as recording dots.

As illustrated in FIG. 5, the recording head includes a recording element array consisting of fifty-six (56) LED chips 2-1 to 2-56 which are linearly arranged (this is indicated by the LED chip 2 in FIG. 4). The LED chip 2-1 includes sixty-four (64) LED devices 2-1-1 to 2-1-64, and other LED chips likewise include sixty-four (64) LED devices, respectively. In each LED chip, the LED devices are linearly arranged. An arrangement direction of those LED devices is coincident with an arrangement direction of the LED chips. An arrangement pitch of the LED devices is approximately twelve (12) pieces/mm, and this recording head can perform recording of an A3 size with a density of 300 DPI.

Anodes of N-th (N=1 to 64) LED devices in the respective LED chips are connected to a common wire, and these are driven by anode drivers 1-1 and 1-2 with a constant current. On the other hand, cathodes of sixty-four (64) LED devices in each LED chip are connected in the chip and are successively driven in a time-sharing manner by cathode drivers 3-1 to 3-6 for fifty-six (56) channels. The cathode driver is constructed by six (6) chips each sharing ten (10) channels. Therefore, the matrix-driving of 64×56 can be performed.

Figure 1:
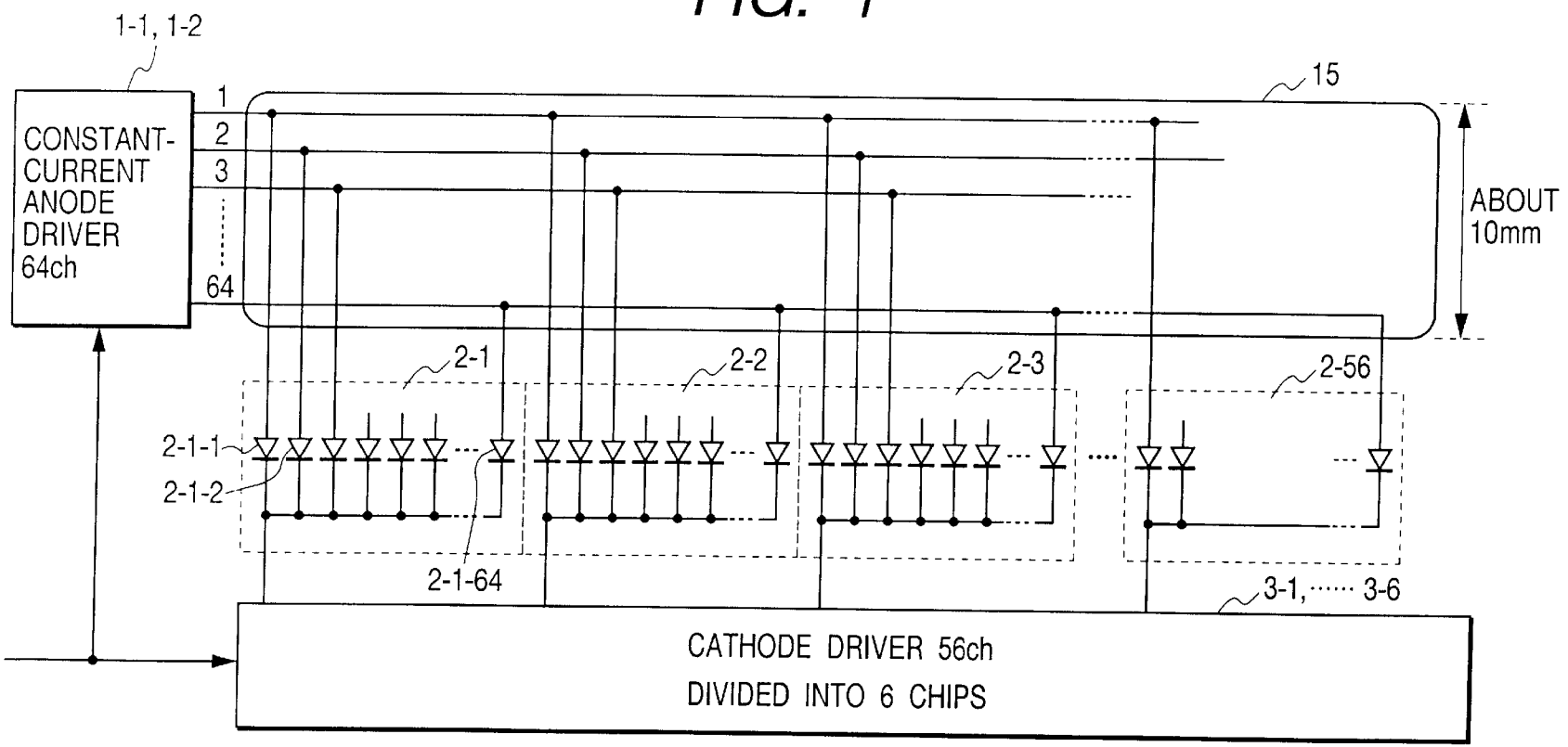
FIG. 1 is a view illustrating an equivalent circuit of a matrix-driving LED recording head.
Figure 2:
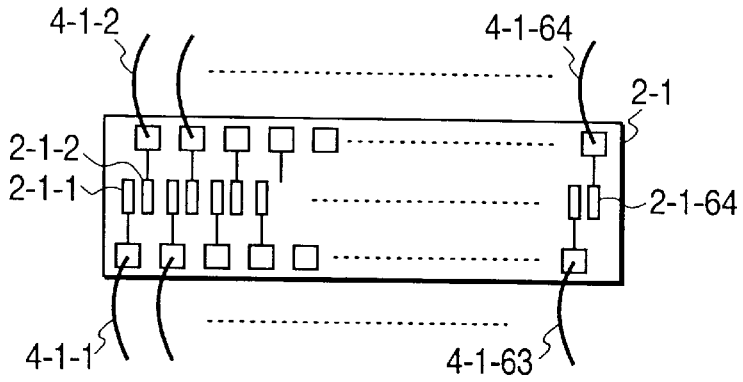
FIG. 2 is a plan view of an LED chip.

As illustrated in FIG. 6, the flexible wiring substrates 6-1 and 6-2 are arranged on opposite sides of the fifty-six (56) LED chips 2-1 to 2-56, and each substrate 6-1, 6-2 has a connection width (a size in the arrangement direction of the LED chips) of about 300 mm. In the LED devices 2-1-1 to 2-1-64 of the LED chip 2-1, anode terminals of odd-numbered elements extend to an opposite side (with respect to the the LED devices) to those of even-numbered elements (i.e, the lower and upper sides in FIG. 6 respectively), and wire bonding pads (WBPs) are connected to end portions of the respective anode terminals. This point is the same as illustrated in FIG. 2. Therefore, the arrangement pitch of the WBPs is approximately 6 pieces/mm. Further, cathode terminals of the LED chip 2-1 extend to a side of the bottom surface of this LED chip, and those cathode terminals are connected to a wiring-pattern on an upper surface of the substrate 10 through the silver paste 12. As illustrated in FIG. 6, this wiring-pattern extends to the outside of the LED chip 2-1 and forms a WBP 18-1. This is the same for other LED chips 2-2 to 2-56.

At the end portion of one flexible wiring substrate 6-1 opposed to the LED chips 2, gold-plated electrode patterns 7-1-1, . . . are formed with an arrangement pitch of about six (6) pieces/mm. At the end portion of the other flexible wiring substrate 6-2 opposed to the LED chips 2, gold-plated electrode patterns 7-1-2, . . . are formed with an arrangement pitch of about six (6) pieces/mm. Those respective electrode patterns are connected to corresponding anode terminal WBPs and cathode terminal WBPs 18-1, 18-2, . . . of the respective LED chips by the bonding wires 4. The LED chip my be connected to the substrate 10 using silver palladium paste or the like. In this case, WBPs 18-1, 18-2, . . . can be formed by silver palladium or the like, and there is no need to form a wiring-pattern on the substrate 10 to connect the WBPs 18-1, 18-2, the cathode terminal. The wire bonding is conducted to those WBPs.

A matrix-wiring portion is formed an each flexible wiring substrate 6-1, 6-2. Although, according to the depiction of FIG. 5, only anode-side wiring is formed in the flexible wiring substrates 6-1 and 6-2, the cathode-side wiring is also formed in the flexible wiring substrates 6-1 and 6-2 as discussed above.

In the above LED recording head, the flexible wiring substrates 6-1 and 6-2 are connected to the substrate 10 with the thermo-setting adhesive 11, and no solder or the like is used to execute this connection. Therefore, radiation characteristics and the like of the LED chip are not adversely affected by flux or the like, and the terminal patterns of the flexible wiring substrates 6-1 and 6-2 can be positioned within about 1 mm of the LED chips. As a result, the width of the substrate 10 can be narrowed to about 6 mm.

Since the matrix-wiring portion is formed in each flexible wiring substrate 6-1, 6-2 as discussed above, the number of connections of signal lines between the flexible wiring substrates 6-1 and 6-2 and the substrates 8-1 and 8-2 is only about seventy (70) connections per each 300 mm, of width. Therefore, an ordinary thermal welding of solder can be used.

Figure 3:
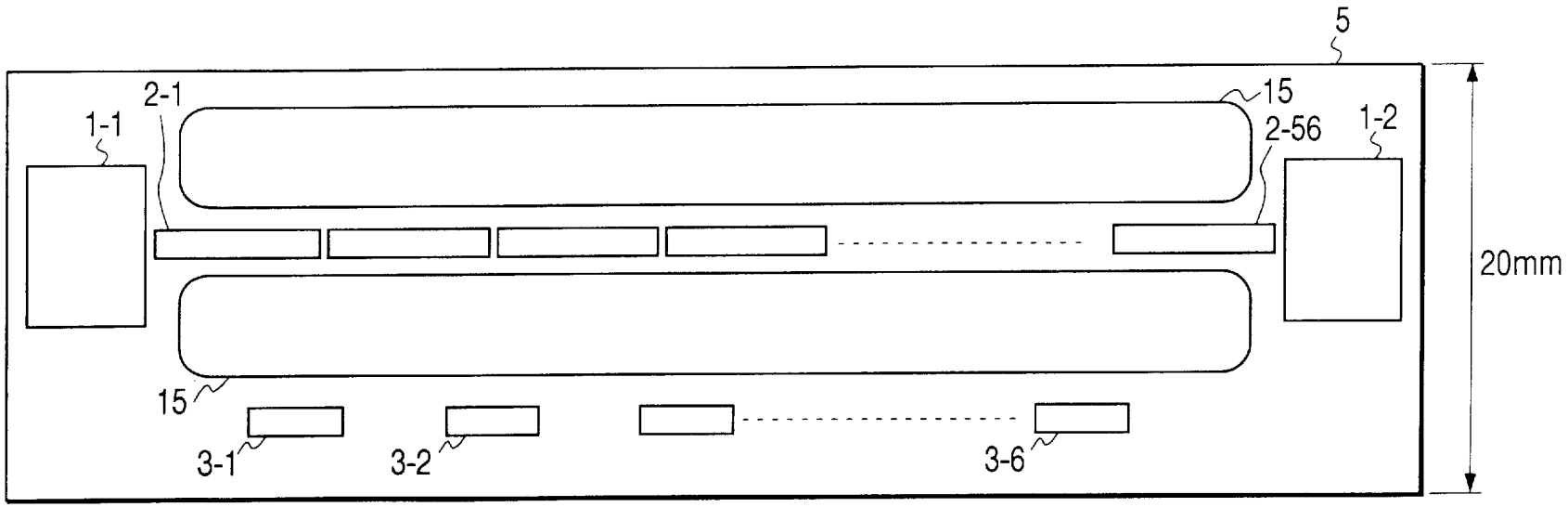
FIG. 3 is a schematic plan view of a conventional LED recording head.

Furthermore, in the above-discussed conventional apparatus, the anode drivers 1-1 and 1-2 (FIG. 3) were located at both ends sides of the LED chip arrangement in the longitudinal direction. By contrast in the above-described embodiment the anode drivers, are arranged on separate substrates 8-1 and 8-1 and the substrates 8-1 and 8-2 are mounted on side surfaces of the support member 9. Therefore, the length of the recording head is reduced, and the entire length of the recording head can be approximately confined within the effective recording width without any waste.

Figure 7:
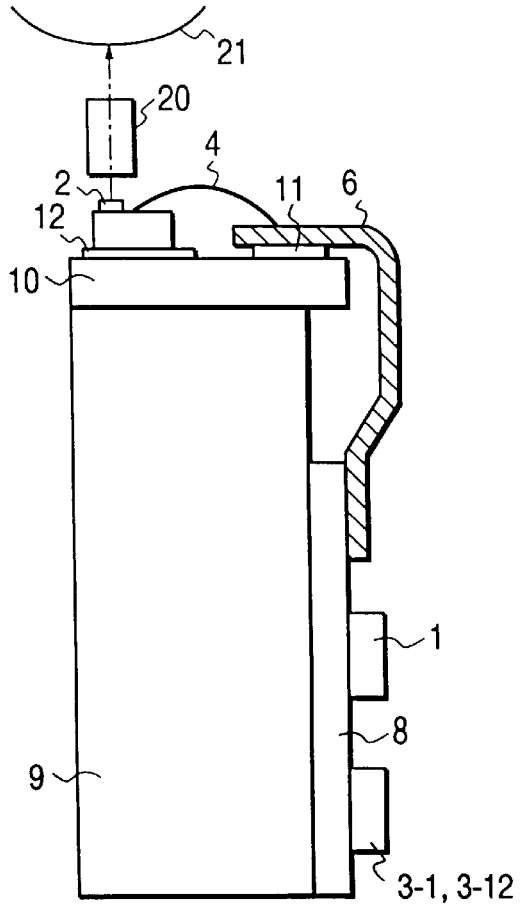
FIG. 7 is a schematic cross-sectional view showing a second embodiment of a recording head according to the present invention.
Figure 8:
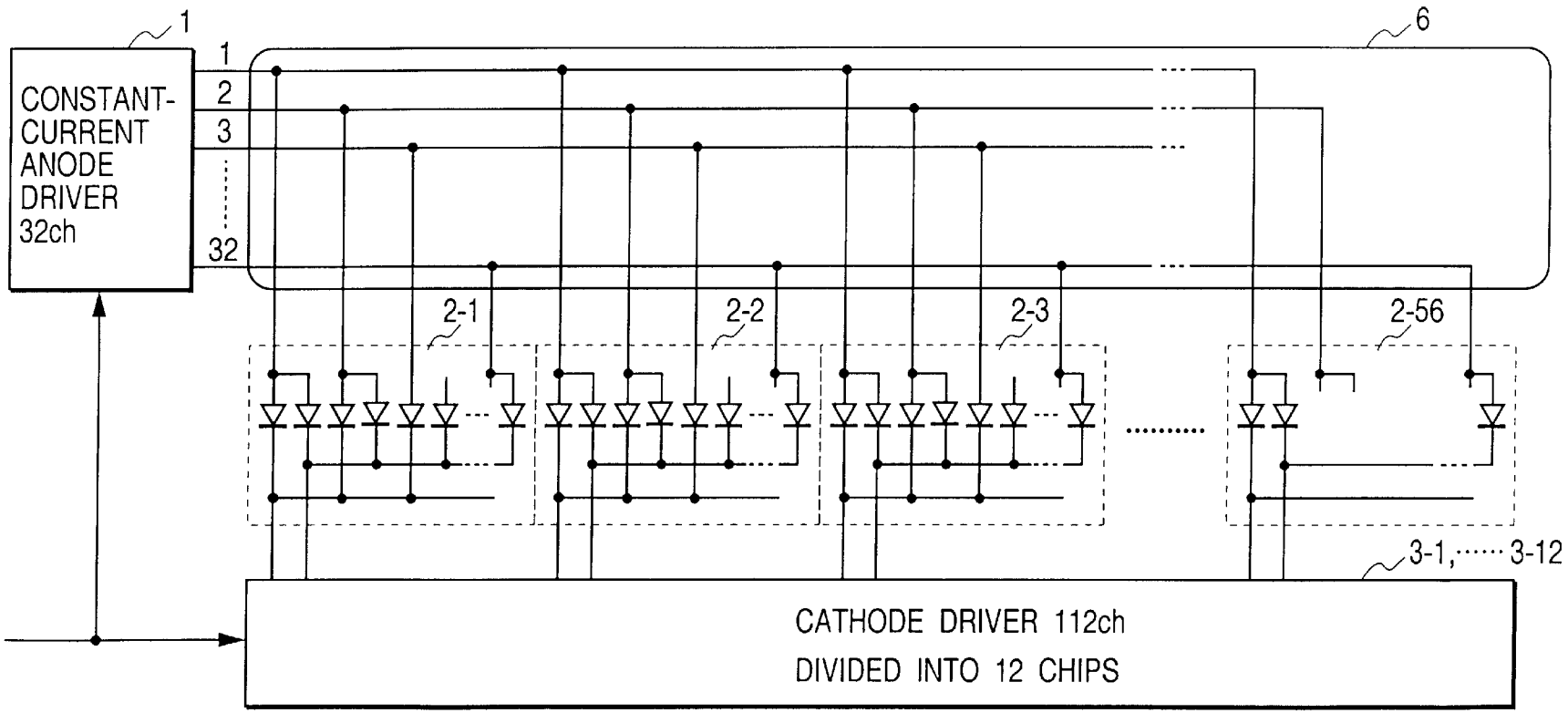
FIG. 8 is a view showing an equivalent circuit of the second embodiment of a recording head according to the present invention.
Figure 9:
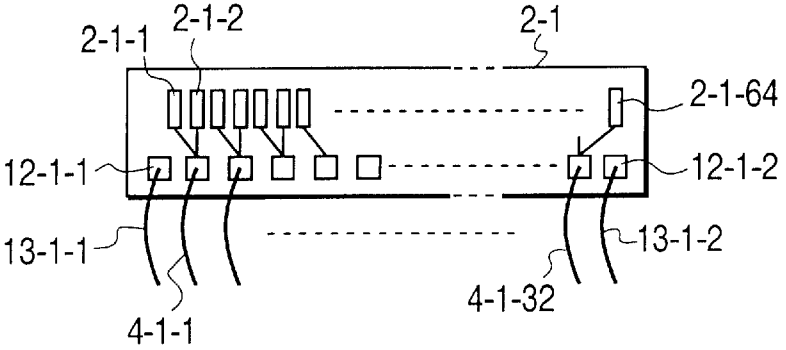
FIG. 9 is a partial plan view showing the second embodiment of a recording head according to the present invention.
Figure 10:
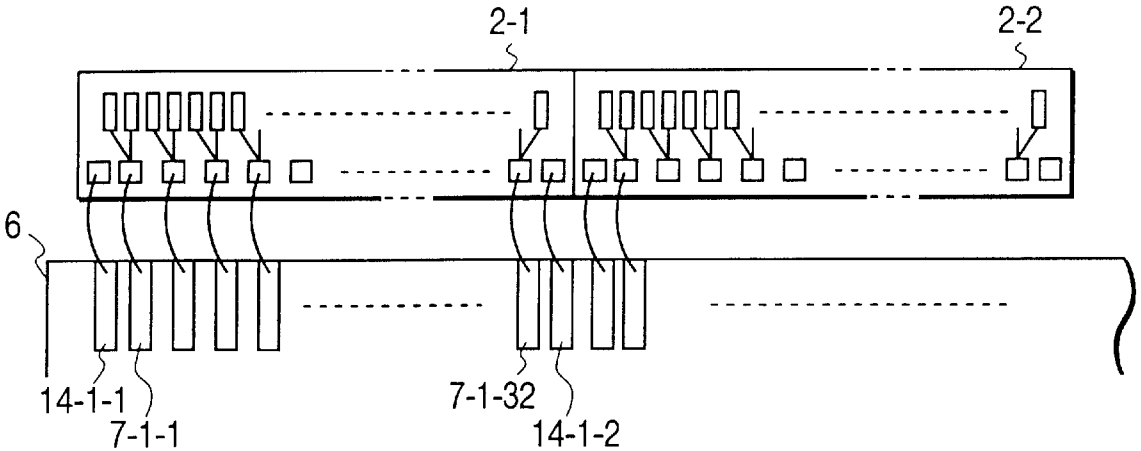
FIG. 10 is a partial plan view showing the second embodiment of a recording head according to the present invention.

FIG. 7 is a schematic cross-sectional view of a second embodiment of a recording head. FIGS. 8, 9 and 10 are respectively a view of its equivalent circuit and its partial plan views. In those figures, such elements as have the same functions as those illustrated in FIGS. 4 to 6 are denoted by the same reference numerals.

The second embodiment is directed to an LED recording head adapted to perform recording of an A3 size with 300 DPI, similarly to the first embodiment. The second embodiment is, however, different from the first embodiment in that the matrix-wiring of sixty-four (64) LED devices in each LED chip is executed by two sets of common cathode lines. That is, since the matrix-wiring of 32×2 is carried out in each chip, the number of WBPs in each LED chip is reduced to about a half of that of the above-discussed first embodiment.

As illustrated in FIG. 8, the recording head of the second embodiment includes fifty-six (56) LED chips 2-1 to 2-56 which are linearly arranged (indicated as the LED chip 2 in FIG. 7). As illustrated in FIG. 9, the LED chip 2-1 has sixty-four (64) LED devices 2-1-1 to 2-1-64, and other LED chips likewise include sixty-four (64) LED devices, respectively. The LED devices are linearly arranged in each LED chip, and the arrangement direction of those LED devices is the same as the arrangement direction of those LED chips. The arrangement pitch of the LED devices is approximately twelve (12) pieces/mm.

As represented in FIGS. 7 to 10, anodes of N-th (N is an even number in a range from 2 to 64) and (N-1)-th LED devices in each LED chip are respectively connected to common wires and driven with a constant current by the anode driver 1. Therefore, the number of anode terminal WBPs of the LED chip 2-1 is thirty-two (32), and those WBPs are connected to the flexible wiring substrate 6 by bonding wires 4-1-1 to 4-1-32. The odd-numbered cathodes and even-numbered cathodes of the sixty-four (64) LED devices in each LED chip are connected in the chip to the other odd-numbered and even-numbered cathodes, respectively. The cathodes are successively driven in a time-sharing manner by cathode drivers 3-1 to 3-12 for 112 channels. Therefore, there are two (2) cathode terminal WBPs in each LED chip 2-1, which are arranged on an upper surface of the LED chip 2-1, as indicated by reference numerals 12-1-1 and 12-1-2, similarly to the anode terminal WBPs. The cathode driver is comprised of twelve (12) chips each sharing ten (10) channels. As a result, the matrix-driving of 32×112 can be effected.

As illustrated in FIGS. 9 and 10, regarding the LED chip 2-1, there are arranged a total of thirty-four (34) WBPs comprised of thirty-two (32) anode terminal WBPs and two (2) cathode terminal WBPs 12-1-1 and 12-1-2 formed on both sides of the arrangement of the anode terminal WBPs. The thirty-two (32) anode terminal WBPs and the two (2) cathode terminal WBPs 12-1-1 and 12-1-2 are respectively connected to corresponding electrode patterns 7-1-1 to 7-1-32 (anode terminals) and 14-1-1 and 14-1-2 (anode terminals) formed on a connection end portion of the flexible wiring substrate 6 through bonding wires 4-1-1 to 4-1-32 and 13-1-1 and 13-1-2. The remaining LED chips have a similar structure. The anode driver 1 and cathode drivers 3-1 to 3-12 are mounted onto the substrate 8 fixed to the side surface of the support member 9, and the wiring pattern on the substrate 8 is connected to the end portion of the flexible wiring substrate 6.

In the above LED recording head, the number of WBPs in each chip is thirty-four (34). Therefore, the WBPs can be arranged on one side of the chip, and it is possible to wire-bond the WBPs to a single flexible wiring substrate 6.

In this embodiment, because the wire-bonding is connected on the surface side of the LED chip for the cathode terminals and anode terminals, there is no need to form a wiring-pattern on the substrate 10. Hence, the substrate 10 can be made of heat-resisting glass or the like. In this case, thermal expansion of the substrate 10 due to heat generation and the like of the LED chip can be moderated, and it is possible to provide a still more inexpensive recording head in which warp and bend of the substrate are extremely small even when the substrate width is thin, for example, less than 5 mm.

Figure 11:
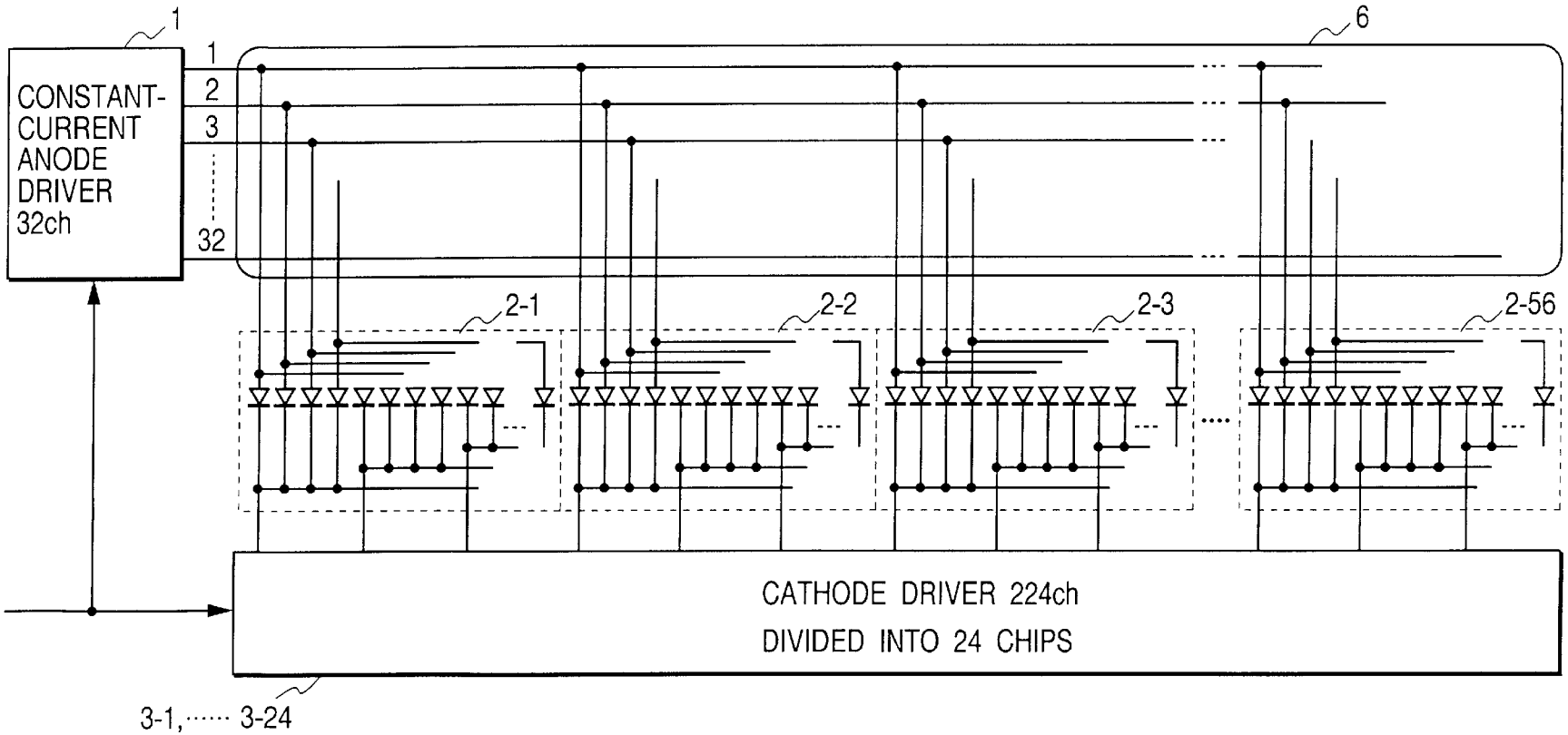
FIG. 11 is a view showing an equivalent circuit of a third embodiment of a recording head according to the present invention.

FIG. 11 is a view of an equivalent circuit of a third embodiment of a recording head according to the present invention. In FIG. 11, elements that have the same functions as those illustrated in FIGS. 4 to 10 are denoted by the same reference numerals.

The third embodiment is directed to an LED recording head adapted to perform recording of an A3 size sheet with 600 DPI. The third embodiment is an example in which the matrix-wiring of 128 LED devices is performed using four sets of common cathode lines in each LED chip having a length of about 5.4 mm. That is, matrix-wiring of 32×4 is carried out in each chip, and a total of thirty-six (36) WBPs including thirty-two (32) anode terminal WBPs and two cathode terminal WBPs located at each end of the arrangement of the anode terminal WBPs (for a total of four cathode terminal WBPs) are connected to the flexible wiring substrate 6 via bonding wires. The cathode driver includes twenty-four (24) chips, each sharing ten (10) channels. As a result, a matrix-driving configuration of 32×224 can be achieved.

Also, since there are thirty-six (36) WBPs in each chip, the WBPs can be arranged on one side of the chip, and it is possible to wire-bond the WBPs to a single flexible wiring substrate. Thus, an LED recording head of 600 DPI can be obtained at reduced cost and in a compact form.

In the above-discussed embodiments, the substrates 8, 8-1 and 8-2 and the flexible wiring substrates 6, 6-1 and 6-2 are separately formed, but it is possible to cause the flexible wiring substrates 6, 6-1 and 6-2 to have functions of the substrates 8, 8-1 and 8-2. That is, the anode drivers 1, 1-1 and 1-2 and the cathode drivers 3-1 to 3-12 may be mounted together on the flexible wiring substrates 6, 6-1 and 6-2. As a result, the number of component members and the manufacturing cost can be further reduced.

Further, in the above-discussed embodiments, the recording element is an LED device. The present invention, however, can also be applied similarly to other apparatuses which can be matrix-driven, such as recording heads having a thermal recording element (which performs recording on the basis of thermal energy) or an LCD recording element (which performs recording on the basis of optical energy by using a light source and a liquid crystal).

As described in the foregoing, according to the present invention, it is possible to provide a recording head which can be made compact in size and at reduced cost by forming matrix-wiring on a flexible wiring substrate.

What is claimed is:

1. A recording head comprising:

first and second semiconductor chips, each of said chips having a plurality of recording elements, said recording elements of said first chip corresponding to respective ones of said recording elements of said second chip, each recording element having first and second terminals;

a first driver adapted to drive said recording elements, said first driver having a common terminal; and a matrix-wiring electrically connecting said chips to said first driver so that said first terminal of a recording element on said first semiconductor chip and said first terminal of the corresponding recording element on said second semiconductor chip are connected to said common terminal of said first driver, said matrix wiring being formed on a flexible substrate.

2. A recording head according to claim 1, wherein said recording head further comprises a second driver cooperating with said first driver to drive said recording elements, said second driver having first and second common terminals, and said matrix-wiring electrically connects said chips to said second driver so that at least two second terminals of the recording elements on said first chip are connected to said first common terminal of said second driver and at least two second terminals of the recording elements on said second chip are connected to said second common terminal of said second driver.

3. A recording head according to claim 1, wherein said recording head further comprises a first solid substrate mounting said first and second chips, a second solid substrate mounting said first driver, and a support member having a top surface and a side surface, and said first solid substrate is supported on said top surface of said support member, and said second solid substrate is supported on said side surface of said support member.

4. A recording head according to claim 3, wherein said side surface is generally perpendicular to said top surface.

5. A recording head according to claim 1, wherein each of said recording elements comprises a light emitting diode.

* * * * *

UNITED STATES PATENT AND TRADEMARK OFFICE

CERTIFICATE OF CORRECTION

PATENT NO. : 6,300,969 B1
DATED : October 9, 2001
INVENTOR(S) : Hiroshi Tanioka

It is certified that error appears in the above-identified patent and that said Letters Patent is hereby corrected as shown below:

Title page,
Item [56], References Cited, FOREIGN PATENT DOCUMENTS,
"4348962" should read -- 4-348962 --;
"8156325" should read -- 8-156325 --; and
"8187889" should read -- 8-187889 --.

Column 1,
Line 24, "matrix driving" should read -- matrix-driving --;
Line 29, "matrixdriving" should read -- matrix-driving --; and
Line 37, "linealy" should read -- linearly --.

Column 2,
Line 5, "is" should be deleted; and
Line 54, "matrixwriting" should read -- matrix-writing --.

Column 4,
Line 12, "ends of" should read -- end of each --, and "substrates" should read -- substrate --;
Line 29, "-to" should read -- to --; and
Line 64, "the the" should read -- the --.

Column 5,
Line 20, "my" should read -- may --;
Line 24, "18-2, the" should read -- 182, … to the --;
Line 26, "an" should read -- on --;
Line 45, "mm," should read -- mm --;
Line 50, "sides" should be deleted;
Line 52, "embodiment" should read -- embodiment, -- and "drivers," should read -- drivers --; and
Line 53, "8-1" (2nd occurrence) should read -- 8-2, --.

UNITED STATES PATENT AND TRADEMARK OFFICE

CERTIFICATE OF CORRECTION

PATENT NO. : 6,300,969 B1
DATED : October 9, 2001
INVENTOR(S) : Hiroshi Tanioka

It is certified that error appears in the above-identified patent and that said Letters Patent is hereby corrected as shown below:

Column 6,
Line 47, "(anode" (2nd occurrence) should read -- (cathode --.

Signed and Sealed this

Twenty-seventh Day of January, 2004

JON W. DUDAS
*Acting Director of the United States Patent and Trademark Office*